US008079183B2

(12) United States Patent
Lenney

(10) Patent No.: US 8,079,183 B2
(45) Date of Patent: Dec. 20, 2011

(54) DE-ICED GUTTER DEBRIS PRECLUSION SYSTEM

(76) Inventor: Robert C. Lenney, Newcastle, CA (US)

( * ) Notice: Subject to any disclaimer, the term of this patent is extended or adjusted under 35 U.S.C. 154(b) by 0 days.

(21) Appl. No.: 12/454,302

(22) Filed: May 15, 2009

(65) Prior Publication Data

US 2010/0287846 A1 Nov. 18, 2010

(51) Int. Cl.
*E04D 13/00* (2006.01)

(52) U.S. Cl. ..... 52/12; 52/11; 219/213

(58) Field of Classification Search ..... 52/11, 12; 219/213

See application file for complete search history.

(56) References Cited

U.S. PATENT DOCUMENTS

| | | | | |
|---|---|---|---|---|
| 3,691,343 | A * | 9/1972 | Norman | 219/213 |
| 4,308,696 | A * | 1/1982 | Schroeder | 52/11 |
| 4,769,526 | A * | 9/1988 | Taouil | 219/213 |
| 5,127,200 | A * | 7/1992 | Doran | 52/12 |
| 5,315,090 | A * | 5/1994 | Lowenthal | 219/213 |
| 5,391,858 | A * | 2/1995 | Tourangeau et al. | 219/213 |
| 5,878,533 | A * | 3/1999 | Swanfeld, Jr. | 52/11 |
| 6,225,600 | B1 * | 5/2001 | Burris | 219/213 |
| 6,598,352 | B2 * | 7/2003 | Higginbotham | 52/12 |
| 6,700,098 | B1 * | 3/2004 | Wyatt et al. | 219/213 |
| 6,708,452 | B1 * | 3/2004 | Tenute | 52/11 |
| 6,759,630 | B1 * | 7/2004 | Tenute | 219/213 |
| 6,959,512 | B2 * | 11/2005 | Cobb | 52/12 |
| 7,104,012 | B1 * | 9/2006 | Bayram | 52/12 |
| 7,310,912 | B2 | 12/2007 | Lenney | |
| 7,448,167 | B2 | 11/2008 | Bachman | |
| 2005/0257433 | A1 * | 11/2005 | Dussault et al. | 52/12 |
| 2006/0037252 | A1 * | 2/2006 | Gosse et al. | 52/11 |
| 2006/0117670 | A1 | 6/2006 | Tsioris | |
| 2006/0123710 | A1 * | 6/2006 | Lenney et al. | 52/12 |
| 2006/0213129 | A1 * | 9/2006 | Bachman | 52/11 |
| 2006/0277831 | A1 * | 12/2006 | Bachman | 52/11 |
| 2006/0283096 | A1 * | 12/2006 | Bachman | 52/11 |
| 2007/0094939 | A1 | 5/2007 | Bachman | |
| 2007/0234647 | A1 * | 10/2007 | Higginbotham | 52/12 |
| 2007/0246449 | A1 * | 10/2007 | Bachman | 219/213 |
| 2009/0056234 | A1 * | 3/2009 | Brochu | 52/12 |

* cited by examiner

*Primary Examiner* — Robert Canfield
*Assistant Examiner* — Babajide Demuren
(74) *Attorney, Agent, or Firm* — Glen L. Gross, Esq.; Shlesinger, Arkwright & Garvey, LLP

(57) ABSTRACT

The system includes a substantially rigid body providing underlying support for a filtering layer, such as in the form of a screen. The body includes a heating wire or other heat source coupled thereto with the body formed of heat conductive material. The body is configured with multiple ribs extending up from a floor so that heat transfer from the body to the screen can occur in a variety of different locations to keep the screen sufficiently heated. The body also includes a wing for interfacing with roofing and openings to allow water filtering through the screen to migrate down into the gutter. A cover overlies a channel which can contain one or more heating wires that experience resistive heating when an electric current is applied thereto.

10 Claims, 4 Drawing Sheets

DE-ICED GUTTER DEBRIS PRECLUSION SYSTEM

FIELD OF THE INVENTION

The following invention relates to gutter debris preclusion systems, also known as gutter guards, which are adapted to be placed on rain gutters such as those provided on the eaves of a house or other structure to collect water therein while precluding debris from collecting within the gutter. More particularly, this invention relates to rain gutter debris preclusion systems which include a heat source to melt ice, snow or other frozen water collecting thereon so that the system can function when frozen water is encountered adjacent the system.

BACKGROUND OF THE INVENTION

The problem of debris collecting within gutters is well documented. Many different forms of gutter debris preclusion systems, often referred to as "gutter guards," have been developed to discourage debris from collecting within the gutter. Some such gutter guards are of a type which provide merely a rigid barrier with holes therein so that water can pass through but debris cannot. Such simple systems suffer from the serious drawback that the holes must be large enough that water will pass through rather than adhering due to surface tension and adhesion forces to edges of the holes. On the other hand, the holes must be small enough to prevent debris from passing therethrough. Experience has shown that the compromises required with such simple gutter guard systems lead to serious deficiencies in the performance of such gutter guard systems, either not effectively allowing water to pass therethrough or too often allowing debris to pass therethrough.

Other gutter guard systems utilize solid rigid layers of material with a sharp curve in the surface which water can adhere to, but which debris will not adhere to. Water adheres to the sharply curving metal portion and is routed in a curving path into the gutter, while debris falls off of such a gutter guard. Such gutter guards have advantages and disadvantages which are well documented in the prior art.

A third form of gutter guard known in the prior art utilizes a fine mesh filter element which has sufficiently small holes therein that debris cannot pass therethrough and this fine mesh filter element, which is formed as a thin flexible screen material, is supported upon a rigid underlying support structure that holds the filter element in place, with the underlying support structure having holes therein to route water passing through the filter element down through the support structure and into the gutter. Such two part filter and support structure gutter guards beneficially allow substantially all debris to be precluded from the gutter while allowing high volumes of water to be routed into the gutter. Examples of such gutter guards include those described in U.S. Pat. No. 7,310,912, incorporated herein by reference in its entirety.

One problem experienced by all different types of gutter guard systems in certain environments is that when freezing temperatures are encountered, water on and adjacent the gutter guard will freeze, and preclude water from passing into the gutter. When such gutter guard performance is inhibited, freeze and thaw cycles can result in dangerously large icicles forming off of edges of the gutters or other portions of the roof. Furthermore, the weight of the snow and ice on the gutter guard can potentially damage the gutter or gutter guard, or at least require that it be designed to withstand high loads, increasing the complexity, and cost of the gutter guards.

Another problem with non-de-icing gutter guards is "ice dams" can form. When the heat of the interior of the home is on to warm the house so people feel comfortable, the heat radiates to the roof and begins melting the snow. The melted snow run-off goes down the roof and when it passes the imaginary line of the building wall, the melted snow then encounters the freezing roof again and begins to freeze, building up a wall of frozen water. Then the water begins to pool above the ice dam and then the melted snow has nowhere else to go but to find it's way through the roof and into the home, causing damage.

One solution for de-icing gutters and gutter guards is to utilize wire which transmits heat to adjacent structures when electric power is routed therethrough. In at least one case, a gutter guard of the curving metal cover type has had such a resistive heating wire integrated into the gutter guard so that the surface of the gutter guard could conduct heat from the resistance heating wire to melt frozen water off of the gutter. Such a system is described in U.S. Pat. No. 7,448,167, incorporated by reference herein in its entirety.

Because such curving metal style gutter guards have a single layer of metal forming the entire gutter guard, the wires can simply heat surfaces which come in contact with the frozen water. However, such a solution is not applicable to multi-part gutter guard systems, such as those described below which include a filter element and an underlying support structure. In particular, filter elements are beneficially formed from materials which resist corrosion. Such materials are also generally low in thermal conductance. For instance, of all metals, stainless steel is known for its low corrosion characteristics, but is also known for being very low in thermal conductance, especially for a steel alloy. Such low thermal conductance of screen materials can require either excessive electric power to be routed to the gutter guard system to cause ice thereon to be melted, or suffers from lack of sufficient heat transfer, so that only limited melting of frozen water occurs. Accordingly, a need exists for a gutter debris preclusion system which has the benefit of a filter and underlying support structure style of gutter guard, and which also can effectively be de-iced so that the system can perform when frozen water is experienced, and ameliorate the problem of ice dam formation.

SUMMARY OF THE INVENTION

With this invention a gutter debris preclusion system is provided which can function when frozen water is experienced, and is of a type which includes a filter element supported above an underlying support structure. The system includes a substantially rigid body which provides the underlying support structure. The body includes openings therein which are large enough to allow water to migrate through the rigid body without significant resistance, due to the size of the openings being sufficiently large to overcome tendencies for the water to adhere to the rigid body. A filter element is supported above the rigid body. Both the filter element and the rigid body are formed of metallic heat conducting material and the filter element is provided in contact with the rigid body. A heat source is located adjacent the rigid body to conduct heat into the body and then to the filter element through the body.

Preferably, the rigid body has multiple different ribs to support the filter element over a floor having the openings therein for water passage. These ribs both keep the filter element positioned where desired and also provide multiple points of contact for conduction of heat from the body into the filter element. In this way, heat does not need to transfer through the filter element from one edge to the other, but rather is provided at multiple different locations on the filter element.

Holes in the floor of the rigid body are spaced apart by a space sufficient to allow for heat transfer to occur efficiently through the body to heat each of the ribs or other supports which extend up from the floor of the body to support the filter element. Also, preferably slots and shelves are provided for supporting and capturing ends of the filter element and also for providing further intimate contact for conduction heat transfer between the body and the filter element.

The heat source is preferably in the form of resistive heating wires (at least one) which are coupled to a source of electric power. A channel is provided within the body which can have physical contact with multiple different sides of the wire. A cover is preferably provided over the channel with the cover also formed of heat conducting metallic material and overlies the channel and with the cover also in contact with the wire for further heat transfer from the wire. The cover preferably has holes therein with align with holes in the body so that fasteners can pass through the holes in the cover and the holes in the body and then be routed into the gutter to secure the entire system to the gutter.

Electric power from a source to the wire can be controlled, such as by remote control to give control to an operator, or can be coupled to a thermostat to only come on in certain temperature ranges or can be coupled to other sensors such as moisture sensors or weight load sensors so that electric power is only utilized when moisture is present or when a load is experienced upon the system from the weight of frozen water thereon.

The overall system can be configured along with a gutter system that is coupled to a cistern for rainwater storage. In this way, the potentially significant water that accumulates on a roof of a structure in winter when below freezing temperatures are experienced, can still be effectively captured for later beneficial use, rather than evaporating or migrating off the roof without entering the gutter due to freezing conditions within the gutter. In this way, more efficient rainwater collection can be facilitated.

OBJECTS OF THE INVENTION

Accordingly, a primary object of the present invention is to provide a gutter guard which can function to preclude debris from entering the gutter while allowing water to enter the gutter, both when temperatures above and below freezing are encountered.

Another object of the present invention is to provide a gutter guard system which can melt frozen water thereon.

Another object of the present invention is to provide a gutter guard including a filter element and an underlying support structure which also conducts heat from a heat source through the underlying support structure to the filter element so that the filter element can melt frozen water thereon.

Another object of the present invention is to provide a system for keeping gutters operating in freezing conditions and to prevent icicle formation or damage to the gutter from the weight of frozen water loads and to reduce ice dam buildup.

Another object of the present invention is to provide a de-iced gutter guard which is easy to attach overlying a gutter and to configure to heat frozen water thereon for performance in below freezing conditions.

Another object of the present invention is to provide a method for de-icing a gutter that also precludes debris from entering the gutter.

Other further objects of the present invention will become apparent from a careful reading of the included drawing figures, the claims and detailed description of the invention.

DESCRIPTION OF THE PREFERRED EMBODIMENT

Figure 1:
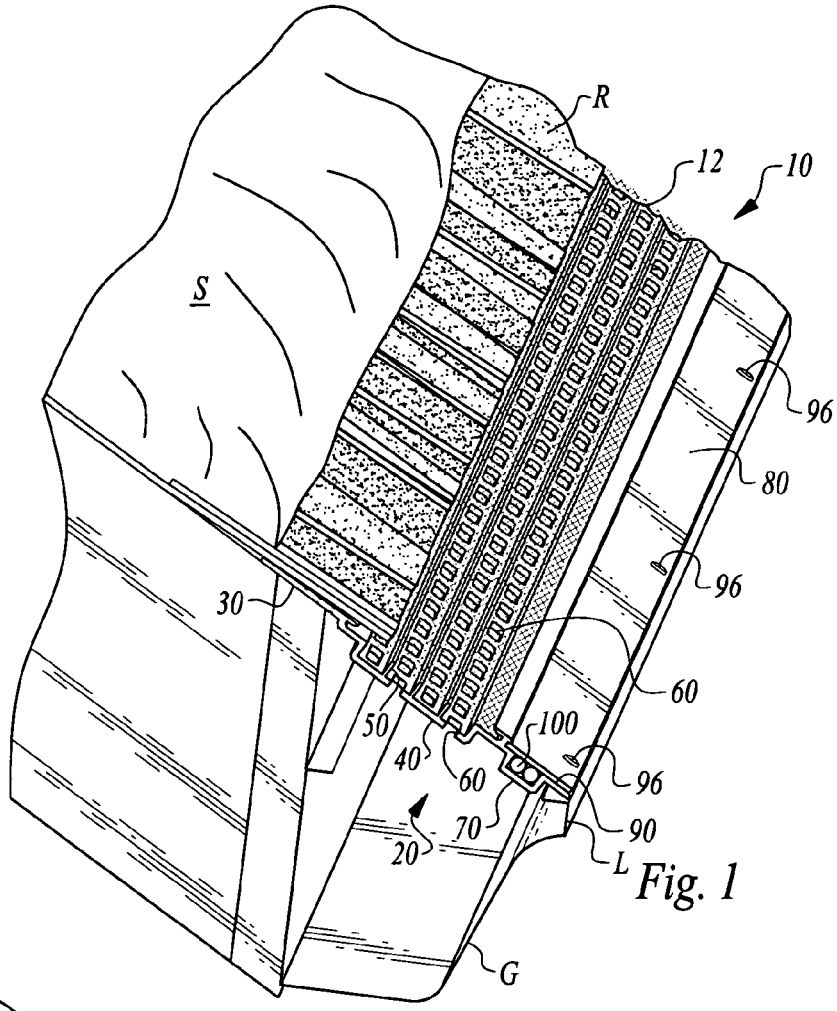
FIG. 1 is a perspective view of the de-iced gutter debris preclusion system of this invention shown upon a gutter at an eave of a roof, with a snow load located upon roofing material and with the gutter debris preclusion system installed over the gutter and functioning to melt frozen water thereon so that it remains free of ice or snow.
Figure 6:
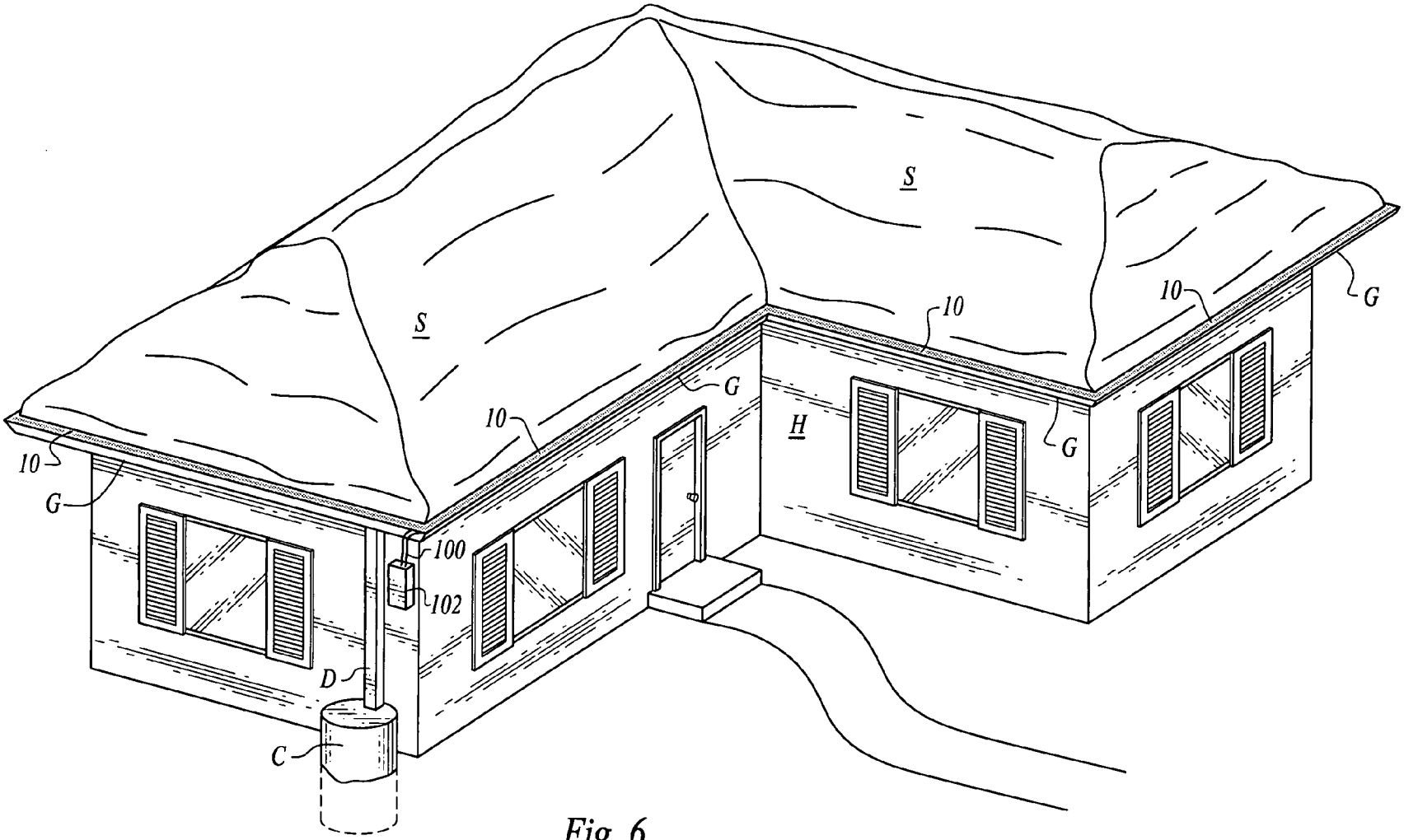
FIG. 6 is a perspective view of a residential structure fitted with the system of this invention and also configured to collect rainwater from the gutter into a rain harvesting storage tank for later beneficial use.

Referring to the drawings, wherein like reference numerals represent like parts throughout the various drawing figures, reference numeral 10 is directed to an assembly of parts forming the system of this invention (FIGS. 1 and 6). The assembly 10 fits upon a gutter G of a house H or other building adjacent an edge of roofing R thereof. The assembly 10 is particularly configured to melt snow S or other frozen water so that the gutter debris preclusion assembly 10 can remain open for passage of water therethrough and collection within the gutter G.

Figure 2:
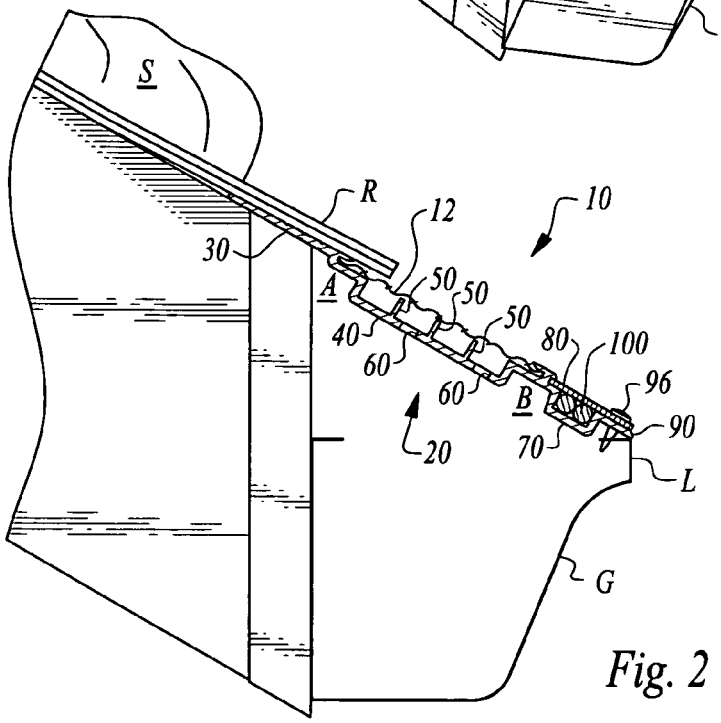
FIG. 2 is an end elevation view of that which is shown in FIG. 1.
Figure 3:
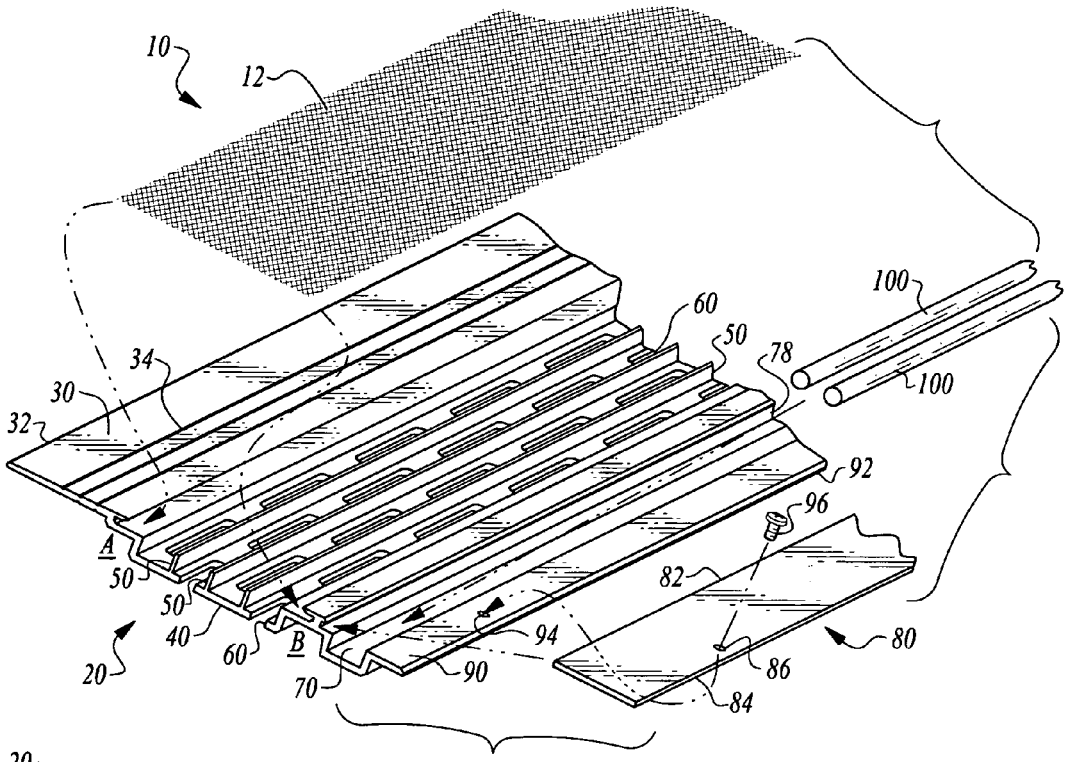
FIG. 3 is a perspective exploded parts view of a portion of that which is shown in FIG. 1, illustrating how the various different parts of the system fit together.
Figure 4:
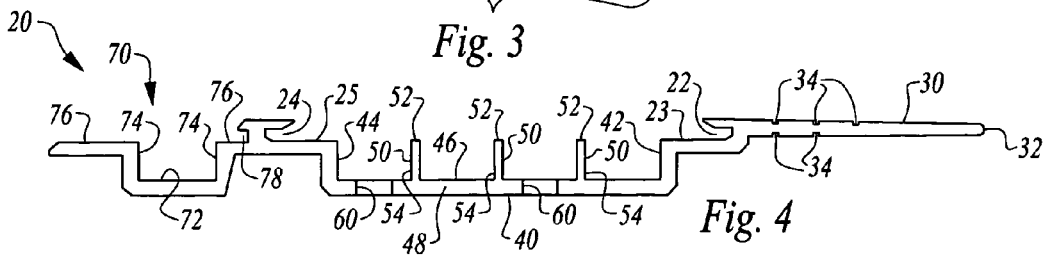
FIG. 4 is an end full sectional view of the body providing an underlying support structure for the filter element of the system of this invention.
Figure 5:
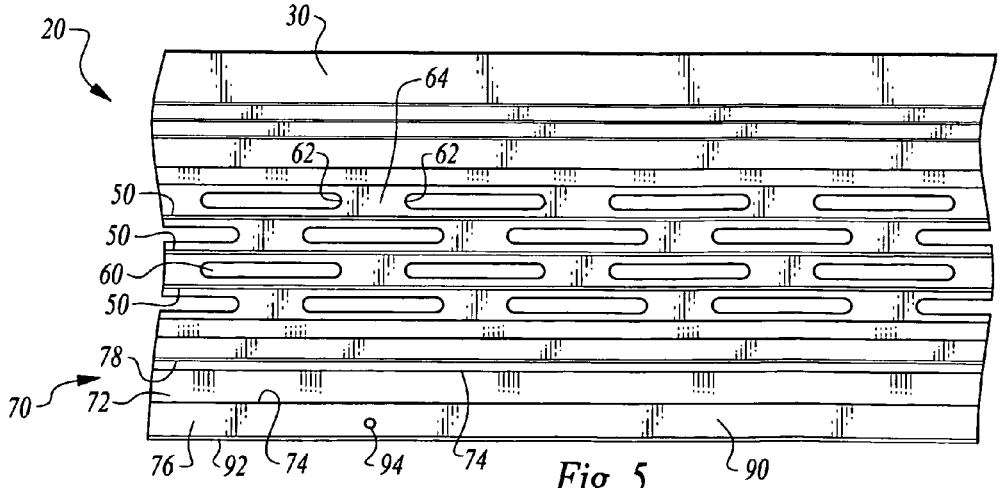
FIG. 5 is a top plan view of a portion of that which is shown in FIG. 4, illustrating patterns and sizes of openings within the body of the system of this invention.

In essence, and with particular reference to FIGS. 1, 2 and 3, basic details of the assembly 10 providing the gutter debris preclusion system of this invention are described, according to a preferred embodiment. The assembly 10 includes a body 20 which is preferably substantially rigid and adapted to be located above a gutter G. The body 20 supports a screen 12 thereon which acts as a filtering layer having small openings therein to allow water to pass therethrough, while precluding passage of debris therethrough.

The body 20 includes a wing 30 which extends from an upper end and is adapted to fit beneath roofing R, such as shingles, and above underlying support structure for the roofing R, such as roof sheeting. The body 20 includes a floor 40 defining a portion of the body 20 which includes a series of openings 60 therein. Ribs 50 also extend up from the floor 40. The ribs 50 help to support the screen 12 above the floor 40.

The openings 60 allow water passing through the screen 12 to pass through the body 20 and fall down into the gutter G.

An end of the body 20 opposite the wing 30, includes a channel 70 therein. This channel 70 is adapted to contain a heating wire 100 or other heat source therein. A cover 80 is preferably provided which is preferably formed of thermally conductive material and which can be located over the channel 70 to enclose the heating wire 100 within the channel 70. The cover 80 is fastened to a front edge 90 of the body 20 and to a lip L of the gutter G through fasteners, such as screws 96, to both hold the cover 80 in place over the channel 70 and hold the front edge 90 of the body 20 to the lip L of the gutter G. The heating wire 100 transmits heat through the body 20 to the screen 12 so that the screen 12 is heated sufficiently to melt snow S or frozen water that comes in contact with the screen 12.

More specifically, and with particular reference to FIGS. 1, 2 and 3, details of the screen 12 are described, as a preferred form of filtering layer for this invention. The screen 12 is preferably in the form of woven stainless steel wire. Preferably, openings within this screen 12 are sufficiently small that substantially no debris can pass through the screen 12. In one embodiment, openings in the screen 12 are between 0.008 inches and 0.25 inches in size with sixteen to ten thousand holes per square inch. The screen 12 is preferably flexible and is kept in a planar form by portions of the body 20 below the screen 12. While other materials could be utilized for the screen 12, stainless steel is relatively strong and avoids corrosion well. Stainless steel is not particularly good at conducting heat, thus benefiting from the design of the body 20 to optimize heat transfer to the screen 12.

With particular reference to FIGS. 1-5, details of the body 20 are described according to this preferred embodiment. The body 20 is preferably a rigid extruded structure, preferably formed of aluminum, especially for aluminum's high thermal conductivity. The body 20 can generally be considered to comprise all of the assembly 10 of this invention other than the screen 12, cover 80 and the heating wire 100.

Portions of the body 20 which hold the screen 12 include an upper slot 22 facing a lower slot 24 on either side of a central portion of the body 20 that is underlaid by the floor 40. The upper slot 22 preferably includes an upper shelf 23 adjacent thereto and between the upper slot 22 and the floor 40. The lower slot 24 preferably includes a lower shelf 25 adjacent thereto and between the lower slot 24 and the floor 40.

The upper shelf 23 and lower shelf 25 are preferably in a common plane substantially coplanar with the slots 22, 24 and substantially coplanar with the screen 12. The screen 12 is preferably captured at ends thereof within the slots 22, 24 and with the screen 12 both in intimate contact with the slots 22, 24 and with the shelves 23, 25. Preferably, the slots 22, 24 can be crimped somewhat to capture edges of the screen 12 therein, such that relative motion is precluded and a high rate of thermal heat transfer can occur between the body 20 and the screen 12.

The upper slot 22 of the body 20 is adjacent the wing 30 which extends beyond the upper slot 22 to a tip 32. This wing 30 is a thin planar structure which is configured so that it can fit between roofing R, such as shingles, and underlying portions of the roof, such as roof sheeting material or a vapor barrier such as tar paper or felt. The wing 30 preferably includes grooves 34 therein which can aid in aligning the wing 30 with the roofing R, and can also provide score marks for shortening of the wing 30 if needed.

The wing 30 is shown extending under the roofing R (e.g. shingles) a few inches, resulting in a margin of roofing R clear of snow S and a lesser chance for ice dam formation. In an alternative embodiment, the wing 30 can be made larger (e.g. six to twelve inches) and increase the width of this snow S free margin, and further reduce or eliminate ice dam formation.

The floor 40 defines a portion of the body 20 which is substantially planar but located below the plane in which the screen 12 is oriented, along with the shelves 23, 25 and the slots 22, 24. The floor 40 is preferably parallel with this screen 12 plane. The floor 40 is defined by an upper wall 42 at one end thereof and a lower wall 44 at the other end thereof. The upper wall 42 extends up to the upper shelf 23 and the lower wall 44 extends up to the lower shelf 25. The floor 40 itself has a top side 46 parallel with an underside 48 with the top side 46 and underside 48 spaced apart by a thickness of the floor 40.

The floor 40 has a plurality of ribs 50 extending from the top side 46 thereof. These ribs 50 preferably extend perpendicularly from the top side 46 and extend to tips 52. The tips 52 are preferably each located in a common plane with the shelves 23, 25 and the slots 22, 24 so that the screen 12 is in contact with the tips 52 of the ribs 50 over the floor 40. The ribs 50 have roots 54 which join the ribs 50 to the top side 46 of the floor 40. The ribs 50 preferably extend in an elongate planar fashion parallel with the upper wall 42 and lower wall 44. Gaps between the ribs 50 provide locations for openings 60 to be formed as holes passing from the top side 46 down to the underside 48 of the floor 40.

These openings 60 are preferably oblong in form with opposite ends 62 which are further apart than a distance between adjacent ribs 50. Spaces 64 are located between adjacent openings 60 between each rib 50. These spaces 64 preferably are at least one-fourth as long as the length of the openings 60 between the ends 62. In this way, sufficient amounts of the floor 40 remain even after removal of material to form the openings 60, so that heat transfer can effectively occur through the floor 40 from the channel 70 and up each of the ribs 50.

The channel 70 is located within the body 20, preferably on a side of the lower shelf 25 and lower slot 24 opposite the floor 40. This channel 70 is preferably in the form of an open space having a bottom 72 perpendicular to sides 74 above and below the bottom 72. Shelves 76 preferably extend from portions of the sides 74 to join with a cap retaining notch 78 adjacent the lower slot 24, and adjacent the front edge 90 of the body 20.

The channel 70 is preferably twice as wide as it is deep. Preferably, the channel 70 has a depth similar to a diameter of wire, such as the heating wire 100, that is desired to be held within the channel 70. In this way, such wires 100 can be placed as a pair within the channel 70 and the wires 100 will be in contact with each other and in contact with both the sides and the bottom 72. If the wires are too small to contact all surfaces of the channel 70, a spacer made of heat conducting material can take up remaining space to maximize heat transfer to the body 20.

With such maximized contact, rates of heat transfer from the heating wire 100 to the body 20 can be maximized. The channel 70 could be sized merely wide enough for a single wire. The channel 70 could have a curving undersurface to maximize surface contact with a heating wire 100. If a heat source other than the heating wire 100 is utilized, the contour of the channel 70 can be appropriately modified to maximize heat transfer from any such alternative heat source.

While the location shown for the channel 70 is preferred, the channel 70 and heat wires 100 or other heat sources could be located elsewhere adjacent the body 20. For instance, the channel 70 and wires 100 could be located at point A or point B (FIG. 2). With particular reference to FIGS. 1, 2, 2A and 3, details of the cover 80 are described, according to a preferred embodiment and alternative embodiments. The cover 80 is preferably a planar sheet of metallic heat conducting material, such as aluminum sized to reside over the channel 70. The cover 80 includes a first edge 82 adapted to reside within the cap retaining notch 78 and a second edge 86 opposite the first edge 82.

Screw holes 86 are located within the second edge 84. The screw holes 86 are spaced apart a distance similar to the holes 94 provided as mounting holes 94 adjacent the tip 92 of the front edge 90 of the body 20. In this way, screws 96 can pass through both the screw holes 86 in the cover 80 and the mounting holes 94 in the front edge 90 of the body 20, and then passing through the lip L of the gutter G, to secure both the cover 80 over the channel 70 of the body 20 and secure the body 20 to the gutter G. In one embodiment, aluminum screws are used to maximize heat transfer to the gutter G. A greater number of screws (e.g. twice as many) can be used to further enhance heat transfer while also compensating for aluminum lesser strength compared to steel.

Figure 2A:
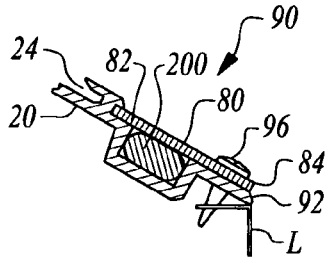
FIG. 2A is an end elevation view of a portion of that which is shown in FIG. 2 for an alternative embodiment heat source of this invention depicted therein.

While the cover 80 is preferably planar in form, it could be contoured to maximize contact with wires within the channel 70 or other heat sources. In FIG. 2A an oblong cross-section wire 200 is shown which fills the channel 70.

The heating wire 100 is shown in FIGS. 1, 2, 3 and 6. The heating wire 100 is preferably a wire which generates heat efficiently when an electric current is applied to the heating wire 100. The heating wire 100 is connected to an electric power source 102 which can be controlled by a switch, or by remote control, or by some form of sensor. In the case of a sensor, the sensor could detect temperature (in the air or on the screen 12 or other portions of the assembly 10), or could sense humidity, or moisture, or weight loads upon the assembly 10.

Programming could be provided so that the electric power source 102 delivers electricity to the heating wire 100 when the program indicates or the sensors indicate the presence of frozen water on the screen 12 or other portions of the assembly 10. When the heating wire 100 is energized, heat transfer occurs from the heating wire 100, through the various different portions of the body 20 to the screen 12. In particular, the screen 12 receives heat through the upper and lower shelves 23, 25, through the upper and lower slots 22, 24 and through the tips 52 of the multiple ribs 50. Because stainless steel is not a particularly good heat transfer material, and because the screen has quite a bit of open space in it, the screen 12 is not a particularly good conductor of heat. Because the snow or other frozen water first comes in contact with the screen 12, it is important that heat transfer be effective to the screen 12. By providing multiple ribs 50, as well as the shelves 23, 25 and the slots 22, 24, heat is transferred to the screen 12 at a variety of different locations on the screen 12. In this way, a minimum of power is required to keep the screen 12 sufficiently warm to melt frozen water thereon.

In one form of the invention, the gutters G are coupled to a downspout D that leads to a cistern C. In such a configuration, the overall system 10 melts frozen water on the roof of the house H and this water is not lost, but rather is collected within a cistern C. The water can then be later beneficially utilized, such as for irrigation; or if treated, for household use. In this way, even in relatively low moisture environments that still encounter snow, water can be beneficially stored for later use.

Figure 2B:
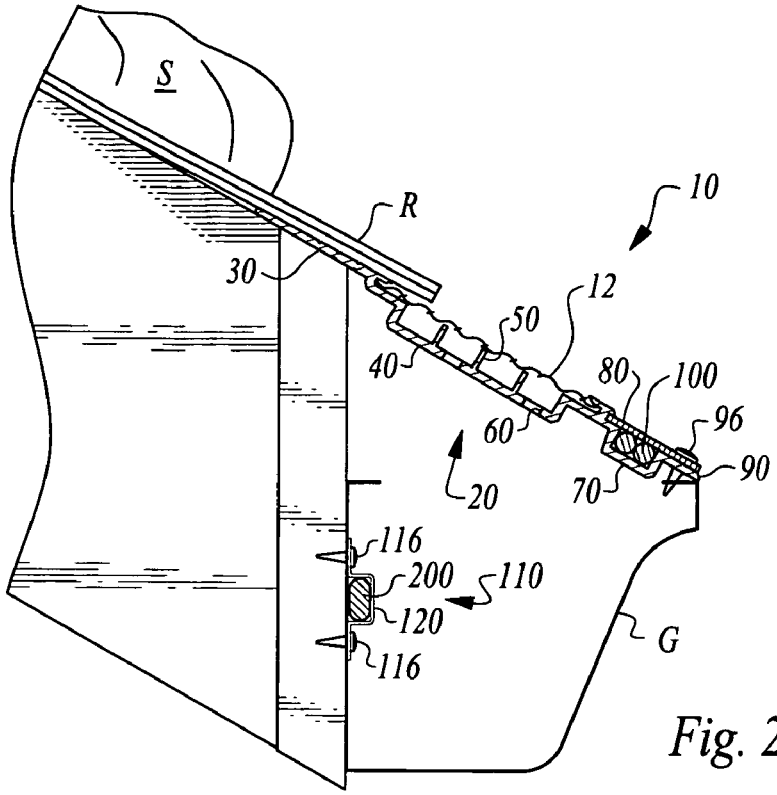
FIG. 2B is an end section view of an alternative embodiment of that which is shown in FIG. 2, featuring an auxiliary heat source bracket to enhance water melting ability inside the gutter.
Figure 2C:
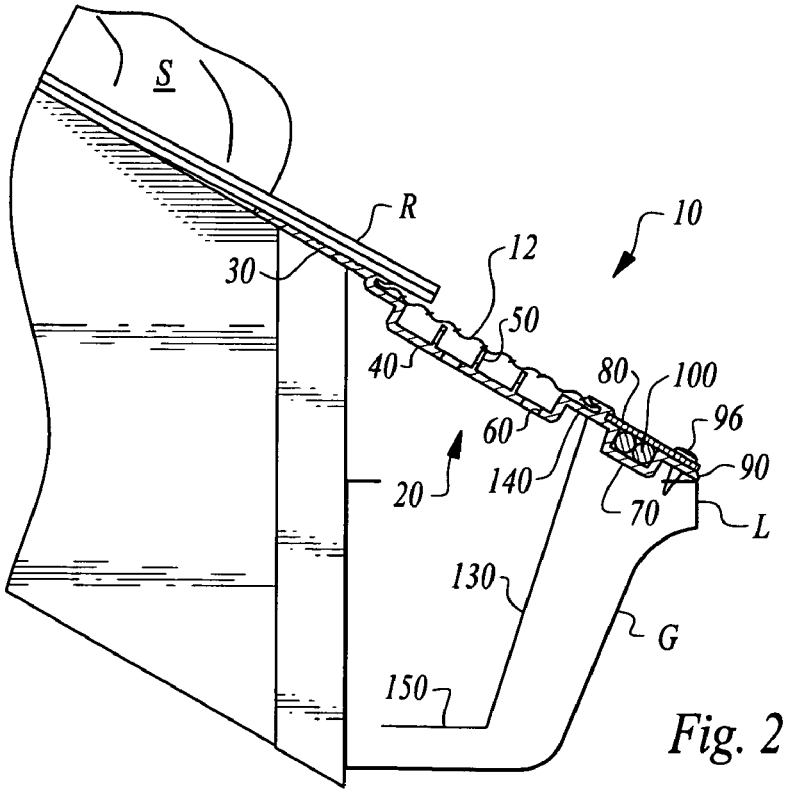
FIG. 2C is an end section view of an alternative embodiment of that which is shown in FIG. 2, featuring a flange to enhance water melting ability to the gutter.

With particular reference to FIGS. 2B and 2C, further enhancements to the assembly 10 of the preferred embodiment of this invention are disclosed. With reference to FIG. 2B, an auxiliary heating bracket 10 is provided. This bracket is elongate in form with a constant cross-section similar to that depicted in FIG. 2B. The bracket 110 includes a channel 120 which can receive an oblong heating wire 200 therein, or a pair of heating wires 100 (FIGS. 1, 2 and 3) or some other heat source. Screws 116 allow for mounting of the auxiliary heating bracket 110 where desired. As shown in FIG. 2B, this auxiliary heating bracket 110 can be placed down within the gutter G, such as on a rear wall thereof, to assist in melting snow within the gutter G. The placement of the auxiliary heating bracket 110 could be at the bottom of the gutter G or the front of the gutter G, or at any other place where needed to enhance the water melting characteristics of the overall system 10 that includes the auxiliary heating bracket 110.

FIG. 2C depicts another embodiment that modifies the system 10 of this invention to enhance performance thereof, and particularly to keep the gutter G flowing. In this embodiment, an extension flange 130 is provided which is an elongate piece of aluminum or other highly thermally conductive material. The flange 130 has a constant cross-sectional form similar to that depicted in FIG. 2C. The extension flange 130 has a head 140 which can be braised, welded or securely fastened to an underside of the body 20. Thus, heat is conducted down into the extension flange 130.

The extension flange 130 extends down to a foot 150 which can be in contact with a bottom of the gutter G. In this way, not only does the extension flange 130 directly melt frozen water within the gutter G, but also it can be in contact with portions of the gutter G spaced from the body 20, and utilize the gutter G for further heat transfer to melt water and keep the gutter G with flowing water therein.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A de-icing gutter debris preclusion system comprising in combination:

a substantially rigid body adapted to be located over a gutter and held in place over the gutter;

said body including a plurality of holes therein adapted to allow water to pass therethrough;

said body formed at least partially of a metallic heat conducting material;

a filter element supported above and in heat transfer facilitating contact with said body;

said filter element formed of a metallic at least somewhat heat conducting material;

a heat source located adjacent said rigid body, said heat source adapted to conduct heat from said heat source, through said rigid body to said filter element sufficient to elevate a temperature of said filter element;

wherein said body includes heat transfer ribs extending up from a heat conductive floor, said floor including at least some of said plurality of holes therein for passage of water through said body, said filter element located in contact with said ribs at tips of said ribs opposite said floor;

wherein said tips of said ribs are located in a common plane with said filter element, said filter element adapted to be oriented in a substantially planar form;

wherein slots are provided in said body in a plane common with said tips of said ribs, said slots including an upper slot on one side of said ribs and a lower slot on another side of said ribs, each of said slots facing each other at least partially, each of said slots adapted to receive edges of said filter element therein, said filter element captured within said slots both to hold said filter element adjacent said body and to allow heat transfer between said filter element and said body;

wherein substantially planar shelves are provided between said slots and said ribs, said shelves adapted to be in contact with said filter element and support said filter element in a plane common with said tips of said ribs on sides of said body opposite there said ribs are located and adjacent said slots;

wherein a channel is located in said body on a side of said lower slot opposite said ribs and said lower shelf, said channel supporting said heat source therein;

wherein said heat source includes wire and experiences resistance heating when electric power is applied to said wire, said wire located within said channel and in contact with walls of said channel, said walls of said channel formed integrally with other portions of said body including said ribs, said shelves and said slots for heat transfer between said wire and said filter element where said filter element is in contact with said rib tips, said shelves and said slots;

wherein a cover overlies said channel, said cover formed of heat conducting metallic material; and wherein a fastener hole is located in said cover, a fastener provided sized to pass through said fastener hole in said cover, said body including a mounting hole therein located below said fastener hole in said cover when said cover is located over said channel, said fastener hole in said cover and said mounting hole both located adjacent a lip of the gutter when said body is located adjacent the gutter, said fastener adapted to hold said cover to said body and both said cover and said body to said gutter when said fastener passes through said fastener hole in said cover, said mounting hole in said body and into fastening engagement with the gutter.

2. The system of claim 1 wherein said holes in said floor are elongate in form and located between said ribs extending up from said floor.

3. The system of claim 2 wherein space is provided between adjacent holes, that are positioned between common ribs, said space having a length of at least one-fourth of a length of said holes in said floor.

4. The system of claim 3 wherein said spaces are staggered on opposite sides of said ribs such that said holes are not aligned.

5. The system of claim 3 wherein said spaces are aligned on opposite sides of said ribs, such that spaces on opposite sides of said ribs provide substantially straight heat conducting pathways extending from said channel containing said heat source therein.

6. The system of claim 1 wherein a channel is located in said body on a side of said lower slot opposite said ribs and said lower shelf, said channel supporting said heat source therein.

7. The system of claim 6 wherein said heat source includes wire that experiences resistance heating when electric power is applied to said wire, said wire located within said channel and in contact with walls of said channel, said walls of said channel formed integrally with other portions of said body including said ribs, said shelves and said slots for heat transfer between said wire and said filter element where said filter element is in contact with said rib tips, said shelves and said slots.

8. The system of claim 7 wherein a cover overlies said channel, said cover formed of heat conducting metallic material.

9. A de-icing gutter debris preclusion system comprising in combination:

a substantially rigid body adapted to be located over a gutter and held in place over the gutter;

said body including a plurality of holes therein adapted to allow water to pass therethrough;

said body formed at least partially of a metallic heat conducting material;

a filter element supported above and in heat transfer facilitating contact with said body;

said filter element formed of a metallic at least somewhat heat conducting material;

a heat source located adjacent said rigid body, said heat source adapted to conduct heat from said heat source, through said rigid body to said filter element sufficient to elevate a temperature of said filter element;

wherein a channel is located in said body on a side of said lower slot opposite said ribs and said lower shelf, said channel supporting said heat source therein;

wherein said heat source includes wire that experiences resistance heating when electric power is applied to said wire, said wire located within said channel and in contact with walls of said channel, said walls of said channel formed integrally with other portions of said body including said ribs, said shelves and said slots for heat transfer between said wire and said body including said ribs, said shelves and said slots for heat transfer between said wire and said filter element where said filter element is in contact with said rib tips, said shelves and said slots;

wherein a cover overlies said channel, said cover formed of heat conducting metallic material; and wherein a fastener hole is located in said cover, a fastener provided sized to pass through said fastener hole in said cover, said body including a mounting hole therein located below said fastener hole in said cover when said cover is located over said channel, said fastener hole in said cover and said mounting hole both located adjacent a lip of the gutter when said body is located adjacent the gutter, said fastener adapted to hold said cover to said body and both said cover and said body to said gutter when said fastener passes through said fastener hole in said cover, said mounting hole in said body and into fastening engagement with the gutter.

10. The system of claim 9 wherein a flange is coupled to an underside of said body, said flange formed of heat conductive material, said flange having sufficient length to extend to a lower portion of the gutter and contact the gutter to transfer heat to the lower portion of the gutter.

* * * * *